US008984993B1

(12) United States Patent
Aldredge et al.

(10) Patent No.: US 8,984,993 B1
(45) Date of Patent: Mar. 24, 2015

(54) ONE HANDED LOCKING PLIERS

(71) Applicants: Robert L. Aldredge, Englewood, OH (US); Daniel J Schaefer, Huber Heights, OH (US)

(72) Inventors: Robert L. Aldredge, Englewood, OH (US); Daniel J Schaefer, Huber Heights, OH (US)

( * ) Notice: Subject to any disclaimer, the term of this patent is extended or adjusted under 35 U.S.C. 154(b) by 0 days.

(21) Appl. No.: 14/548,541

(22) Filed: Nov. 20, 2014

(51) Int. Cl.
*B25B 7/12* (2006.01)
*B25B 7/10* (2006.01)

(52) U.S. Cl.
CPC . *B25B 7/123* (2013.01); *B25B 7/10* (2013.01); *B25B 7/12* (2013.01)
USPC ..... 81/367

(58) Field of Classification Search
CPC ..... B25B 7/123; B25B 7/12
See application file for complete search history.

(56) References Cited

U.S. PATENT DOCUMENTS

| | | | | | |
|---|---|---|---|---|---|
| 2,531,285 | A | * | 11/1950 | Manspeaker | 81/344 |
| 2,705,899 | A | * | 4/1955 | Berger | 81/371 |
| 3,208,319 | A | * | 9/1965 | Westby et al. | 81/367 |
| 4,809,534 | A | * | 3/1989 | Osborn | 72/31.1 |
| 5,056,385 | A | * | 10/1991 | Petersen | 81/370 |
| 6,095,019 | A | | 8/2000 | Warheit et al. | |
| 7,762,162 | B2 | | 7/2010 | Phillips, Sr. et al. | |

* cited by examiner

*Primary Examiner* — Bryan R Muller
(74) *Attorney, Agent, or Firm* — Donald J. Ersler

(57) ABSTRACT

A one handed locking pliers preferably includes a fixed jaw, a movable jaw, a fixed handle, a toggle link, a power link and a movable handle. The fixed jaw is retained in a first end of the fixed handle. The movable jaw is pivotally retained in substantially the one end of the fixed handle. An adjustment screw is retained in a second end of the fixed handle. An end of the adjustment screw engages a first end of the toggle link and a first end of the power link is pivotally engaged with a second end of the toggle link. The movable handle includes a handle portion and an actuation portion, which extends from the handle portion. The movable jaw is pivotally engaged with a first end of the actuation portion and the power link is pivotally engaged with a second end of the actuation portion.

18 Claims, 6 Drawing Sheets

ONE HANDED LOCKING PLIERS

BACKGROUND OF THE INVENTION

1. Field of the Invention

The present invention relates generally to hand tools and more specifically to a one handed locking pliers, which requires less effort to operate than that of the prior art.

2. Discussion of the Prior Art

U.S. Pat. No. 5,056,385 to Petersen discloses a compound toggle link. U.S. Pat. No. 6,095,019 to Warheit et al. discloses a locking pliers tool. U.S. Pat. No. 7,762,162 to Phillips, Sr. et al. discloses a locking pliers with cam.

Accordingly, there is a clearly felt need in the art for a one handed locking pliers, which requires less effort to operate than that of the prior art.

SUMMARY OF THE INVENTION

The present invention provides a one handed locking pliers, which requires less effort to operate than that of the prior art. The one handed locking pliers (locking pliers) preferably includes a fixed jaw, a movable jaw, a fixed handle, an adjusting screw, a toggle link, a power link, a biasing device and a movable handle. The phrase, "one handed" means that the locking pliers is operable with a single hand, which allows the other hand to manipulate an object to be clamped in the jaws of the locking pliers. The fixed jaw, the movable jaw, the fixed handle, the adjusting screw and the biasing spring are preferably taken from an Irwin item no. 502L3 vise grips, but other parts may also be used. U.S. Pat. No. 5,056,385 is hereby incorporated into this patent application by reference in its entirety. The fixed jaw is retained in one end of the fixed handle and the adjusting screw is threadably retained in an opposing end of the fixed handle. The movable jaw is pivotally retained in the one end of the fixed handle.

The toggle link includes a first leg, a second leg and a cross member. A first end of the first and second legs is attached to each other and a second end of the first and second legs are separated from each other to receive a thickness of the power link. The toggle link preferably has a substantial "Y" configuration. A screw notch is formed in the first end of the first and second legs to receive an end of the adjustment screw. The cross member is attached to a top of the first and second legs at substantially a middle thereof. A toggle pivot hole is formed through the second end of the first and second legs to pivotally engage the power link. The power link includes a first end and a second end. A toggle pivot hole is formed through the first end of the power link. A handle pivot hole is formed through substantially a second end of the power link. A centerline projection extends downward from a bottom of the power link. The centerline projection contacts an inner surface of the movable handle and forces a pivot point of the power link and the moveable handle to go slightly above a power centerline drawn through a center of a jaw pin and a link pin. A release stop extends from a top of the power link, adjacent the handle pivot hole.

The movable handle includes a handle portion and an actuation portion. The handle portion includes a first end, a second end and a U-shaped cross section. A first end of the actuation portion extends from a first end of the handle portion. The actuation portion includes a first actuation leg, a second actuation leg and a handle cross member. The first actuation leg extends from a first side of the handle portion and the second actuation leg extends from a second side of the handle portion. The handle cross member connects a top of the first and second actuation legs together. A jaw hole is formed through a second end of the actuation portion. A power hole is formed a first end of the actuation portion.

The centerline biasing device includes a pair of pivot links, a spring plunger and a compression spring. A first end of the pair of pivot links is pivotally secured to the first end of the power link. A second end of the pair of pivot links is pivotally secured to the spring plunger. The compression spring is axially retained on the spring plunger. A spring pocket is preferably created in the second end of the handle by attaching a J-shaped cover plate thereto. The compression spring and the spring plunger are retained in the spring pocket.

A jaw pin is retained in the jaw hole in the actuation portion and the movable jaw. A power pin is retained in the power hole of the actuation portion and the handle pivot hole of the power link. A toggle pin is retained in the toggle pivot hole of the power link and the toggle pivot hole of the toggle link. In use, the clamp stop projection contacts an inside surface of the movable handle and prevents an object from being clamped too far over the power centerline. The release stop of the power link contacts the handle cross member of the movable handle and prevents the moveable handle from dropping down too far from the fixed handle.

Accordingly, it is an object of the present invention to provide a locking pliers, which requires less effort to operate than that of the prior art.

These and additional objects, advantages, features and benefits of the present invention will become apparent from the following specification.

DETAILED DESCRIPTION OF THE PREFERRED EMBODIMENTS

Figure 1:
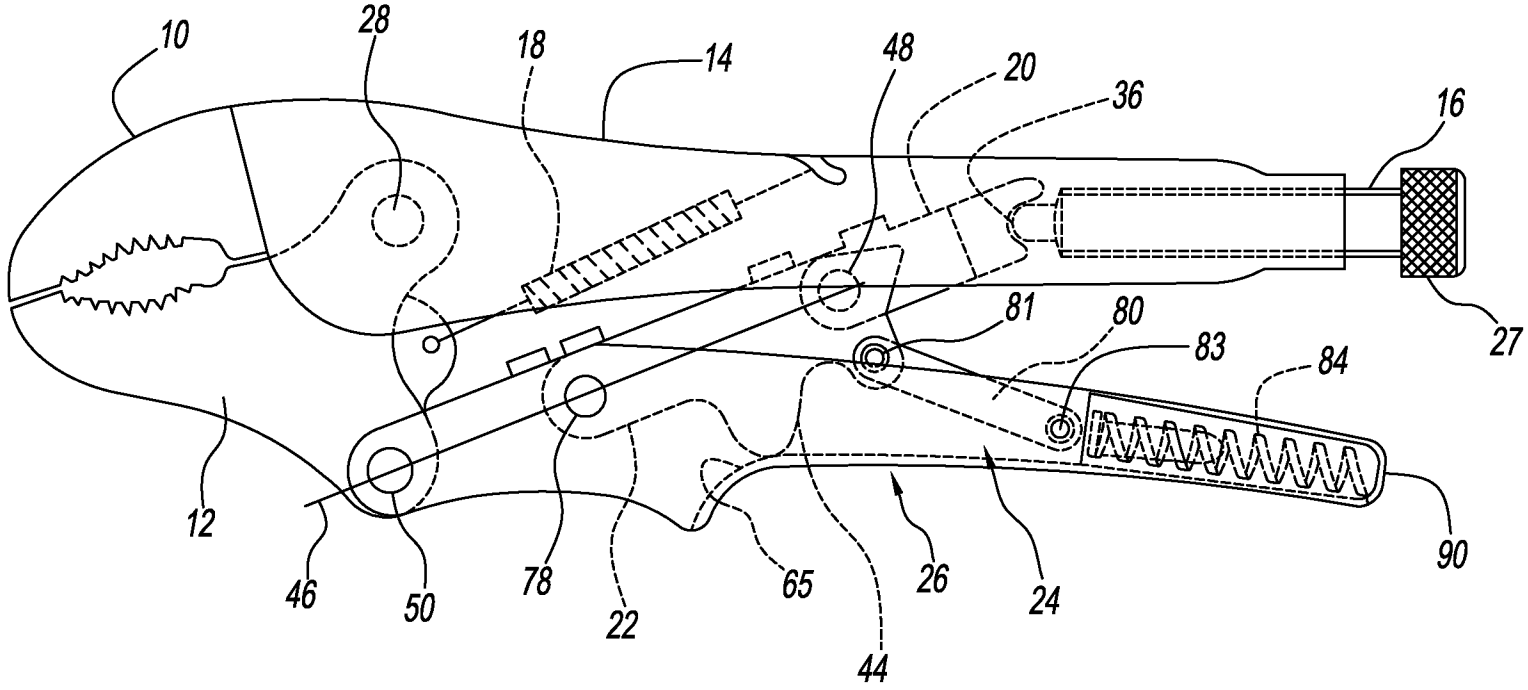
FIG. 1 is a side view of a locking pliers in a closed orientation in accordance with the present invention.
Figure 2:
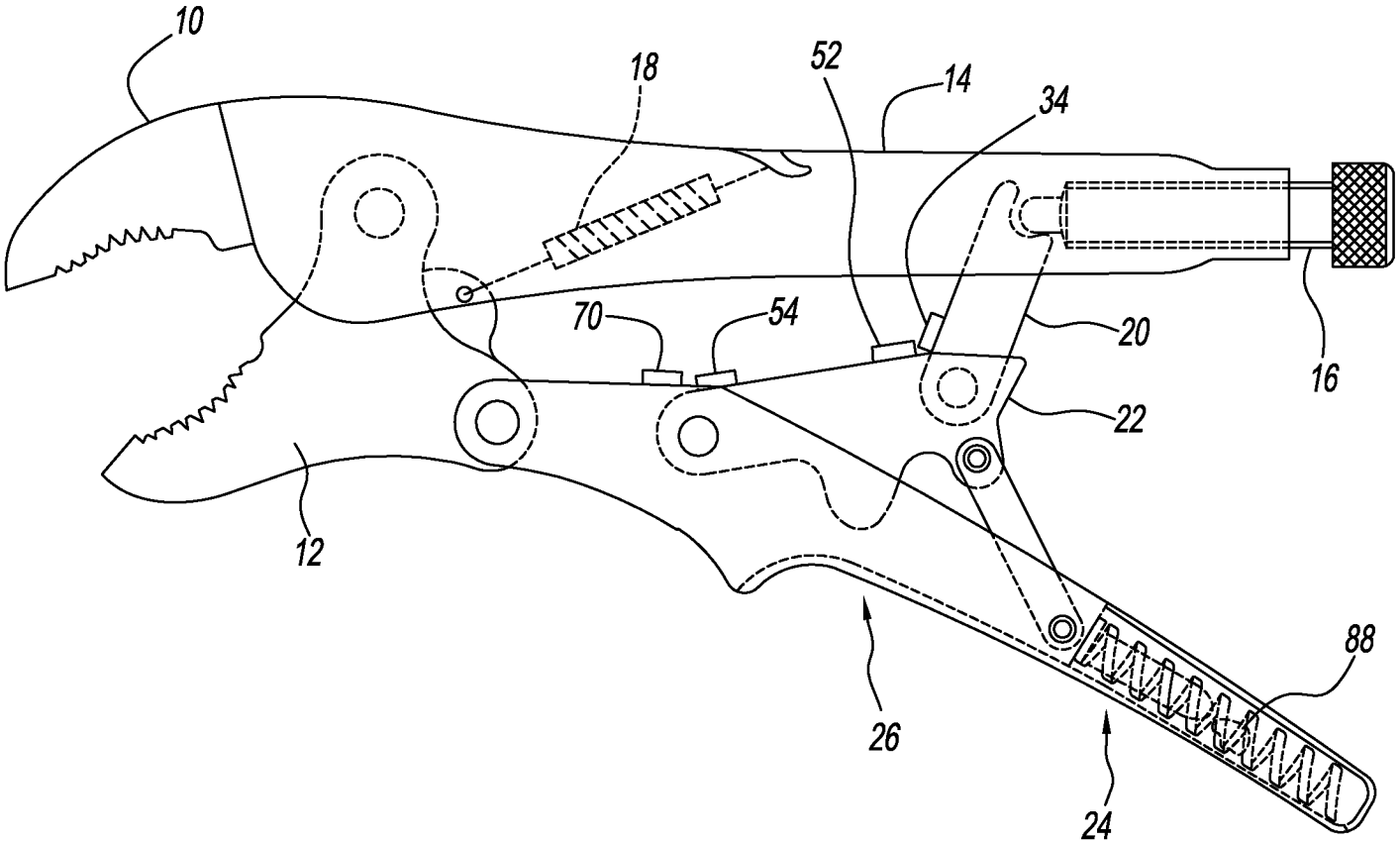
FIG. 2 is a side view of a locking pliers in an open orientation in accordance with the present invention.
Figure 3:
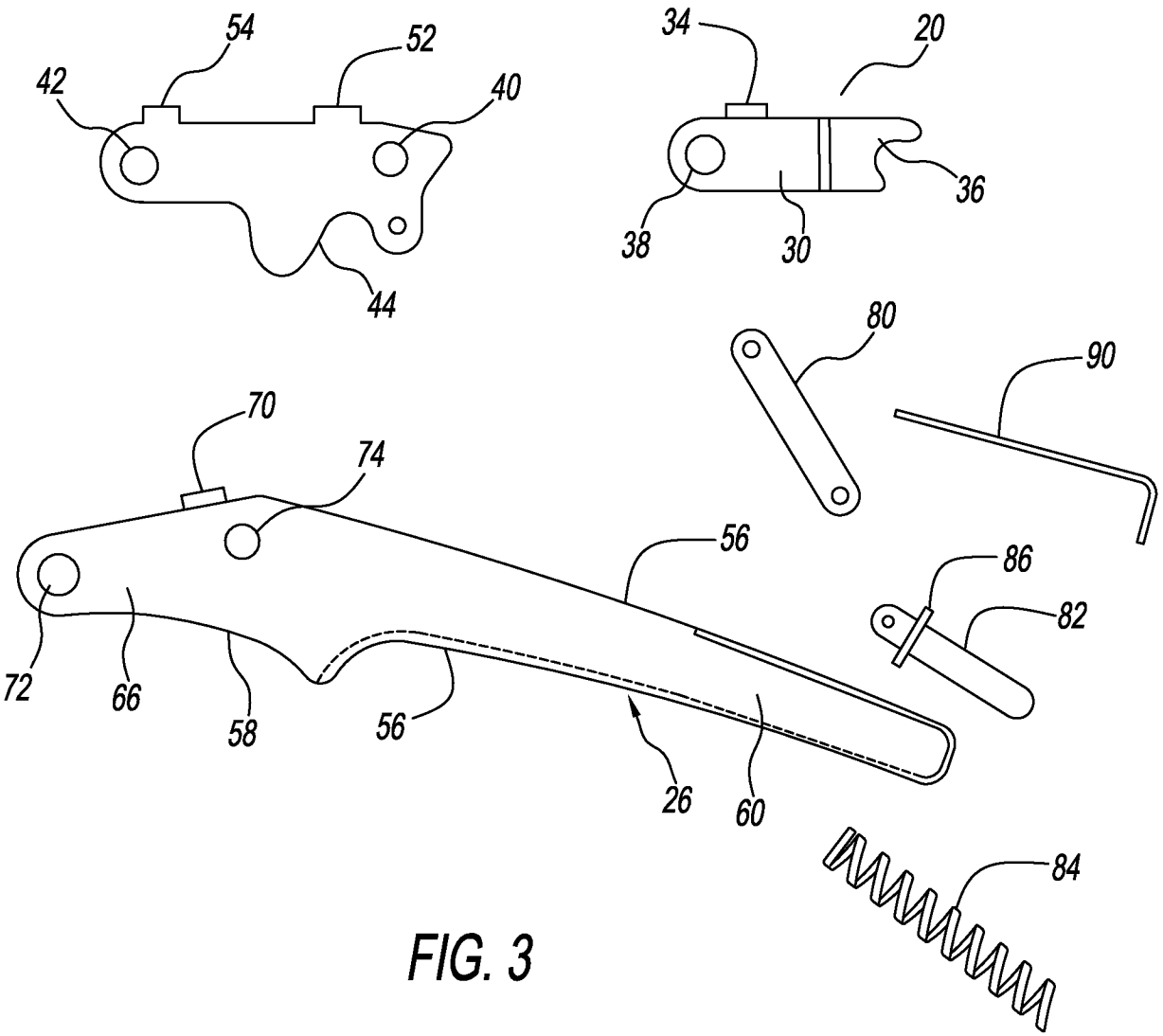
FIG. 3 is an exploded side view of a toggle link, a power link, a movable handle of a locking pliers in an open orientation in accordance with the present invention.

With reference now to the drawings, and particularly to FIG. 1, there is shown a side view of a locking pliers 1 in a closed orientation. With reference to FIGS. 2-3, the locking pliers 1 preferably includes a fixed jaw 10, a movable jaw 12, a fixed handle 14, an adjusting screw 16, a biasing spring 18, a toggle link 20, a power link 22, a centerline biasing device 24 and a movable handle 26. The fixed jaw 10, the movable jaw 12, the fixed handle 14, the adjusting screw 16 and the biasing spring 18 are preferably taken from an Irwin item no. 502L3 vise grips, but other parts may also be used. U.S. Pat. No. 5,056,385 is hereby incorporated into this patent application by reference in its entirety. The fixed jaw 10 is retained in one end of the fixed handle 14 and the adjusting screw is threadably retained in an opposing end of the fixed handle 14. The movable jaw 12 is pivotally retained in the one end of the fixed handle 14 with a pivot pin 28. One end of the biasing spring 18 is attached to the movable jaw 12 and the other end is attached to the fixed handle 14. A knurled head 26 is preferably formed on an end of the adjusting screw 16. The knurled head 27 is used to increase point pressure of the fixed and movable jaws 10, 12.

Figure 4:
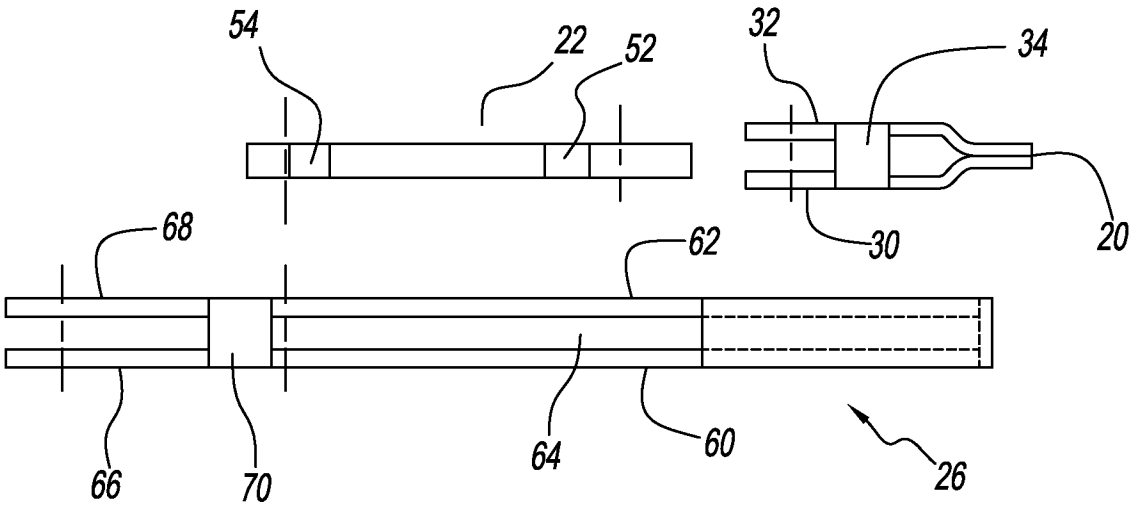
FIG. 4 is an exploded top view of a toggle link, a power link, a movable handle and a centerline biasing device of a locking pliers in accordance with the present invention.

With reference to FIG. 4, the toggle link 20 includes a first leg 30, a second leg 32 and a cross member 34. A first end of the first and second legs 30, 32 are preferably welded to each other and a second end of the first and second legs 30, 32 are separated from each other to receive a thickness of the power link 22. The toggle link 20 preferably has a substantial "Y" configuration. A screw notch 36 is formed in the first end of the first and second legs 30, 32 to receive an end of the adjustment screw 16. The cross member 34 is preferably welded to a top of the first and second legs 30, 32. A toggle pivot hole 38 is formed through the second end of the first and second legs 30, 32 to pivotally engage the power link 22.

The power link 22 includes a first end and a second end. A toggle pivot hole 40 is formed through the first end of the power link 22. A handle pivot hole 42 is formed through substantially a second end of the power link 22. A centerline projection 44 extends downward from a bottom of the power link 22. The centerline projection 44 includes a rounded perimeter. With reference to FIG. 1, the centerline projection 44 contacts an inner surface of the movable handle 26 and forces a pivot point of the power link 22 and the moveable handle 26 to go slightly above a power centerline 46 drawn through a center of a link pin 48 and a jaw pin 50. A power stop projection 52 extends from a top of the power link 22 and is formed adjacent the toggle pivot hole 40. A handle stop projection 54 extends from a top of the power link and is formed adjacent the handle pivot hole 42. A length of the power link 22 is greater than a length of the toggle link 20.

Figure 5:
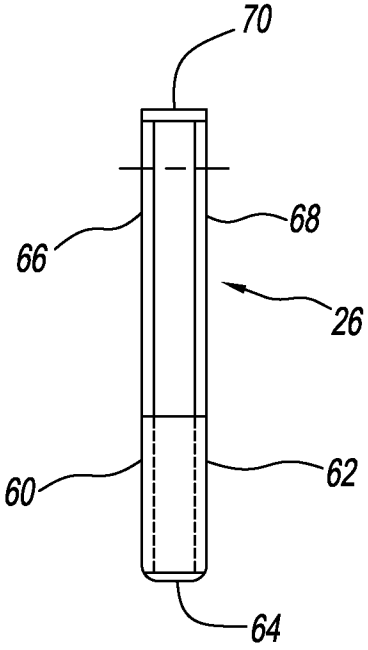
FIG. 5 is an end view of a movable handle of a locking pliers in accordance with the present invention.
Figure 6:
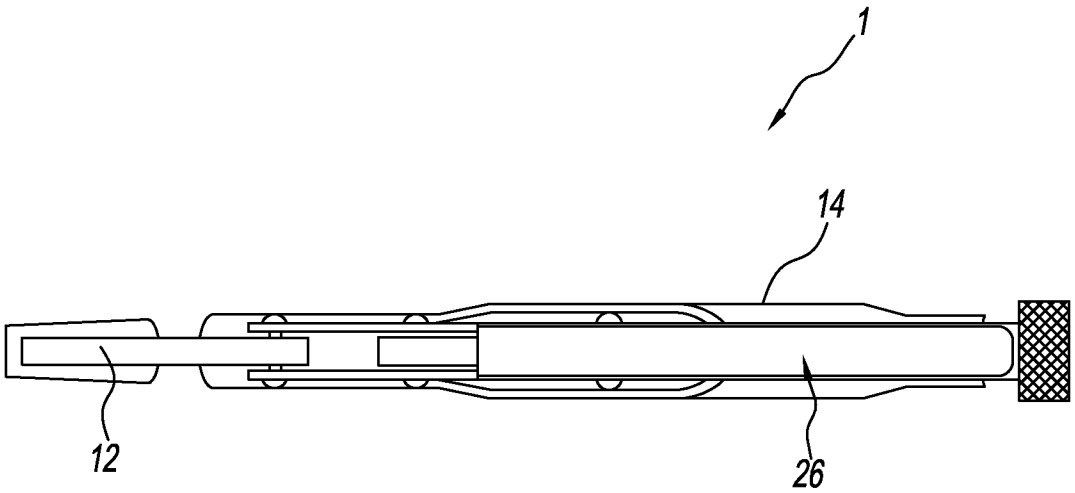
FIG. 6 is a bottom view of a locking pliers in a closed orientation in accordance with the present invention.

With reference to FIG. 5, the moveable handle 26 includes a handle portion 56 and an actuation portion 58. The handle portion 56 includes a first end and a second end. The handle portion 56 also includes a U-shaped cross section. The U-shaped cross section includes a first handle leg 60, a second handle leg 62 and a bottom portion 64. The first handle leg 60 extends upward from a first end of the bottom portion 64 and the second handle leg 62 extends upward from a second end of the bottom portion 64. A first end of the actuation portion 58 extends from a first end of the handle portion 56. The actuation portion 56 includes a first actuation leg 66, a second actuation leg 68 and a handle cross member (handle stop projection) 70. The first actuation leg 66 extends from the first handle leg 60 and the second actuation leg 68 extends from the second handle leg 62. The handle cross member 70 is preferably welded to a top of the first actuation leg 66 and the second actuation leg 68. A jaw hole 72 is formed through a second end of the actuation portion 58. A power hole 74 is formed through the actuation portion 58 at substantially a first end thereof, adjacent the handle cross member 70.

The jaw pin 50 is retained in the jaw hole 72 in the actuation portion 58 and the movable jaw 12. A power pin 78 is retained in the power hole 74 of the actuation portion 58 and the handle pivot hole 42 of the power link 22. The toggle pin 48 is retained in the toggle pivot hole 40 of the power link 22 and the toggle pivot hole 38 of the toggle link 20.

The centerline biasing device 24 includes a pair of pivot links 80, a spring plunger 82 and a compression spring 84. A first end of the pair of pivot links 80 is pivotally secured to the first end of the power link 22 with a first link pin 81. A second end of the pair of pivot links 80 is pivotally secured to the spring plunger 82 with a second link pin 83. The compression spring 84 is axially retained on the spring plunger 82. The spring plunger 82 includes a stop flange 86. A spring pocket 88 is created in the second end of the movable handle 26 by attaching a J-shaped cover plate 90 thereto. The compression spring 84 and the spring plunger 82 are retained in the spring pocket 88.

In use, the clamp stop projection 44 contacts an inside surface 65 of the bottom portion 64 and prevents an object from being clamped too far over the power centerline 46. With reference to FIG. 2, the cross member 34 of the toggle link 20 contacts the release stop 52 of the power link 22 and prevents the moveable handle 26 from dropping too far downward from the fixed handle 14. The power stop projection 54 of the power link 22 contacts the handle cross member 70 of the movable handle 26 and also prevents the moveable handle 26 from dropping too far downward from the fixed handle 14.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

We claim:

1. A one handed locking pliers comprising:

a fixed handle having an adjusting device disposed on one end;

a fixed jaw is rigidly retained in an opposing end of the fixed handle;

a movable jaw is pivotally retained in substantially the opposing end of the fixed handle, wherein rotation of said adjusting device changes a distance between said fixed jaw and said movable jaw;

a movable handle having one end pivotally engaged with said movable jaw and a spring pocket formed in an opposing end of said movable handle;

a power link having a first end and a second end, a centerline projection extending downward from a bottom of said power link, said first end of said power link is pivotally engaged with said movable handle at substantially said one end of said movable handle;

a biasing device includes at least one pivot link, a spring plunger and a compression spring, a first end of said at least one pivot link is pivotally secured to said second end of said power link, a second end of said at least one pivot link is pivotally secured to said spring plunger, said spring plunger and said spring are retained in said spring pocket; and a toggle link having a first end and a second end, said first end of said toggle link is pivotally engaged with an end of said adjusting device, said second end of said toggle link is pivotally engaged with said second end of said power link.

2. The locking pliers of claim 1 wherein:

said adjusting device is an adjustment screw.

3. The locking pliers of claim 1 wherein:

said movable handle includes an actuation portion and a handle portion, said actuation portion extends from said handle portion.

4. The locking pliers of claim 1 wherein:

said toggle link includes a first leg, a second leg and a cross member, a first end of said first and second legs are attached to each other, a second end of said first and second legs are separated from each other to receive a thickness of said power link.

5. The locking pliers of claim 1 wherein:

said power link includes a handle stop projection and a power stop projection, said handle stop projection extends from a side of said power link, adjacent said first end of said power link and facing said fixed handle, said power stop projection extends from a side of said power link, adjacent said second end of said power link and facing said fixed handle.

6. The locking pliers of claim 3 wherein:

a cross member is formed on said actuation portion of said moveable handle.

7. A one handed locking pliers comprising:

a fixed handle having an adjusting device disposed on one end;

a fixed jaw is rigidly retained in an opposing end of the fixed handle;

a movable jaw is pivotally retained in substantially the opposing end of the fixed handle;

a movable handle having one end pivotally engaged with said movable jaw and a spring pocket formed in an opposing end of said movable handle;

a power link having a first end and a second end, a centerline projection extending downward from a bottom of said power link, said first end of said power link is pivotally engaged with said movable handle at substantially said one end of said movable handle;

a biasing device includes at least one pivot link, a spring plunger and a compression spring, a first end of said at least one pivot link is pivotally secured to said second end of said power link, a second end of said at least one pivot link is pivotally secured to said spring plunger, said spring plunger and said spring are retained in said spring pocket; and a toggle link having a first end and a second end, said first end of said toggle link is pivotally engaged with an end of said adjusting device, said second end of said toggle link is pivotally engaged with said second end of said power link, said adjusting device and said power link pivot in parallel axes.

8. The locking pliers of claim 7 wherein:

said adjusting device is an adjustment screw.

9. The locking pliers of claim 7 wherein:

said movable handle includes an actuation portion and a handle portion, said actuation portion extends from said handle portion.

10. The locking pliers of claim 7 wherein:

said toggle link includes a first leg, a second leg and a cross member, a first end of said first and second legs are attached to each other, a second end of said first and second legs are separated from each other to receive a thickness of said power link.

11. The locking pliers of claim 7 wherein:

said power link includes a handle stop projection and a power stop projection, said handle stop projection extends from a side of said power link, adjacent said first end of said power link and facing said fixed handle, said power stop projection extends from a side of said power link, adjacent said second end of said power link and facing said fixed handle.

12. The locking pliers of claim 9 wherein:

a cross member is formed on said actuation portion of said moveable handle.

13. A one handed locking pliers comprising:

a fixed handle having an adjusting device disposed on one end;

a fixed jaw is rigidly retained in an opposing end of the fixed handle;

a movable jaw is pivotally retained in substantially the opposing end of the fixed handle, wherein rotation of said adjusting device changes a distance between said fixed jaw and said movable jaw;

a movable handle having one end pivotally engaged with said movable jaw and a spring pocket formed in an opposing end of said movable handle;

a power link having a first end and a second end, a centerline projection extending downward from a bottom of said power link, said first end of said power link is pivotally engaged with said movable handle at substantially said one end of said movable handle;

a biasing device includes at least one pivot link, a spring plunger and a compression spring, a first end of said at least one pivot link is pivotally secured to said second end of said power link, a second end of said at one least pivot link is pivotally secured to said spring plunger, said spring plunger and said spring are retained in said spring pocket; and a toggle link having a first end and a second end, said first end of said toggle link is pivotally engaged with an end of said adjusting device, said second end of said toggle link is pivotally engaged with said second end of said power link, said adjusting device and said power link pivot have parallel axes.

14. The locking pliers of claim 13 wherein:

said adjusting device is an adjustment screw.

15. The locking pliers of claim 13 wherein:

said movable handle includes an actuation portion and a handle portion, said actuation portion extends from said handle portion.

16. The locking pliers of claim 13 wherein:

said toggle link includes a first leg, a second leg and a cross member, a first end of said first and second legs are attached to each other, a second end of said first and second legs are separated from each other to receive a thickness of said power link.

17. The locking pliers of claim 13 wherein:

said power link includes a handle stop projection and a power stop projection, said handle stop projection extends from a side of said power link, adjacent said first end of said power link and facing said fixed handle, said power stop projection extends from a side of said power link, adjacent said second end of said power link and facing said fixed handle.

18. The locking pliers of claim 15 wherein:

a cross member is formed on said actuation portion of said moveable handle.

* * * * *